United States Patent [19]

Fujita

[11] Patent Number: 4,872,295

[45] Date of Patent: Oct. 10, 1989

[54] ELECTRICALLY-OPERATED FOLDING STAGE SYSTEM

[76] Inventor: Kazuo Fujita, 1-1, Hagiyamadai, Seto-shi, Aichi-ken, Japan

[21] Appl. No.: 212,230

[22] Filed: Jun. 27, 1988

[30] Foreign Application Priority Data

Mar. 25, 1988 [JP] Japan ..... 63-72712

[51] Int. Cl.[4] ..... E04H 3/28

[52] U.S. Cl. ..... 52/7; 182/223

[58] Field of Search ..... 52/6, 7, 71; 272/9; 182/223

[56] References Cited

U.S. PATENT DOCUMENTS

| | | | |
|---|---|---|---|
| 2,841,831 | 7/1958 | Mackintosh | 52/7 |
| 2,978,754 | 4/1961 | Wilson | 52/7 |
| 3,091,816 | 6/1963 | Wetzel | 52/7 |

FOREIGN PATENT DOCUMENTS

| | | | |
|---|---|---|---|
| 527768 | 7/1956 | Canada | 52/7 |
| 753000 | 2/1967 | Canada | 52/7 |
| 45-30907 | 10/1970 | Japan | 52/7 |
| 60-25482 | 7/1985 | Japan | 52/7 |
| 61-16200 | 1/1986 | Japan | 52/7 |

OTHER PUBLICATIONS

Architectural Record: Apr. 1958, p. 65.

*Primary Examiner*—Michael Safavi

*Attorney, Agent, or Firm*—Fred Philpitt

[57] ABSTRACT

Two different types of electrically-operated folding stage systems, namely a high-type system and a low-type system are provided. Each type of system includes a pair of opposed stage components. The high-type system may include an additional pair or pairs of stage components. The opposed stage components are pivotally connected together. Each stage component includes a platform. In the high-type system, a plurality of rows of brackets are fixed to the bottom of the platform. A downwardly-extending upright leg is pivotally connected to the lower end of each bracket to support the entire system on a support such as a floor. Casters may be connected to the lower ends of at least the foremost and rearmost legs of each row to enable the entire system to be moved in a desired horizontal direction on the floor. A pair of opposed geared motors are mounted on the bottom of the platform of at least one of the opposed stage components. A pair of opposed link mechanisms are connected to the motors, respectively. When the motors are rotated in one direction, the link mechanisms make articulating movements from substantially horizontal positions to substantially vertical opposed positions, thereby folding the entire opposed stage components. When the motors are rotated in the opposed direction, the link mechanisms make articulating movements from the vertical positions to the horizontal positions, thereby unfolding the stage components.

8 Claims, 6 Drawing Sheets

(a)

(b)

(c)

ELECTRICALLY-OPERATED FOLDING STAGE SYSTEM

FIELD OF THE INVENTION

This invention relates to electrically-operated folding stage systems.

BACKGROUND OF THE INVENTION

Prior to producing this invention, the inventor proposed two different types of stage systems, namely a high-type one and a low-type one in Japanese Application for Registration of Utility Model No. 59-100829 (published under No. 61-16200). Either of the high-type and low-type stage systems has a guide post to be fixed to a wall or the like, and a balancer mechanism supporting the rear portion of the stage body for vertical movement. Also, either type of system has, on its front portion, wheels to enable the stage body to be moved on a floor. The stage body of either type of system can be displaced or stored from a horizontal position on the floor to a vertical position adjacent to the post. The high-type system includes legs pivotally connected to the bottom of a platform so that the legs make right angles with the platform when supporting the platform on the floor, but change their angles to the platform as the legs are raised away from the floor when the stage body is removed to the vertical position, and become parallel to the platform when the platform is removed to a vertical position. On the other hand, the low-type system includes legs fixed to the bottom of a platform.

However, either type of system may be used only in a place inside or outside a building where its guide post can be fixed to a wall or the like. Also, the stage body cannot have a depth greater than the height of the post. In other words, the depth of the stage body is limited by the height of the post. Therefore, if either type of system is manufactured for use in a place with a floor-to-ceiling height of only 3 to 4 meters, such as a schoolroom, a recreation room or an assembly room of a school or a kindergarten or in an assembly room, a council room or a grand hall of a hotel or the like, the system cannot have a stage body having a depth of more than 3 to 4 meters. Thus it may further be said that the depth of the stage body is limited by the height from the floor to the ceiling.

A stage system similar to the foregoing ones was also proposed in Japanese Application for Registration of Utility Model No. 52-82315 (published under No. 60-25482) filed in the name of the inventor hereof.

Also, a folding stage system was proposed in Japanese Patent Application No. 41-44861 (published under No. 45-30907 and corresponding to U.S. patent application Ser. No. 509138 filed Nov. 22, 1965). This stage system includes a pair of stage components connected to each other so that the components can be displaced from horizontal positions to opposed vertical positions. Thus, if the stage system is used in a room having a floor-to-ceiling height slightly greater than the "folded height" of the system, the system may be so unfolded as to have a depth much greater than the floor-to-ceiling height. That is, the depth of the system is not limited by the floor-to-ceiling height. Also, if a plurality of such stage systems are arranged on a floor in such a manner that the systems make contact with one another, a stage with a desired area may be obtained.

However, the foregoing stage system of the Application No. 41-44861 must be manually folded or unfolded.

In other words, its two stage components must be manually displaced from their horizontal positions to their vertical positions or vice versa. Therefore, the stage components each must be one having such a weight or size that the user or operator can manually displace the component. Also, if a plurality of the stage systems are to be arranged on a floor to provide a stage with a desired area, each system must be manually carried or moved to the required position. Also, since the two stage components of the system are displaced with distal side portions of the components upwardly arcing, additional stage systems cannot be connected to the distal side portions of the system components to provide a larger stage system.

SUMMARY OF THE INVENTION

It is an object of the invention to provide a folding stage system which may be used in a desired place inside or outside a building.

Another object of the invention is to provide a folding stage system which is automatically folded or unfolded.

A still another object of the invention is to provide an electrically-operated folding stage system.

A further object of the invention is to provide a folding stage system whose depth when the system is unfolded is not limited by the floor-to-ceiling height of a room where the system is used.

A still further object of the invention is to provide a folding stage system which provides a relatively great stage area.

These and other objects will be made manifest when considering the following detailed specification.

BRIEF DESCRIPTION OF THE DRAWING

FIG. 3(*b*) shows another embodiment of the means for operating the stage components of the system of FIG. 1;

DETAILED DESCRIPTION OF THE PREFERRED EMBODIMENTS

According to the invention, two different types of electrically-operated folding stage systems, namely, a high-type one and a low-type one may be provided.

High-type Stage System

Figure 1:
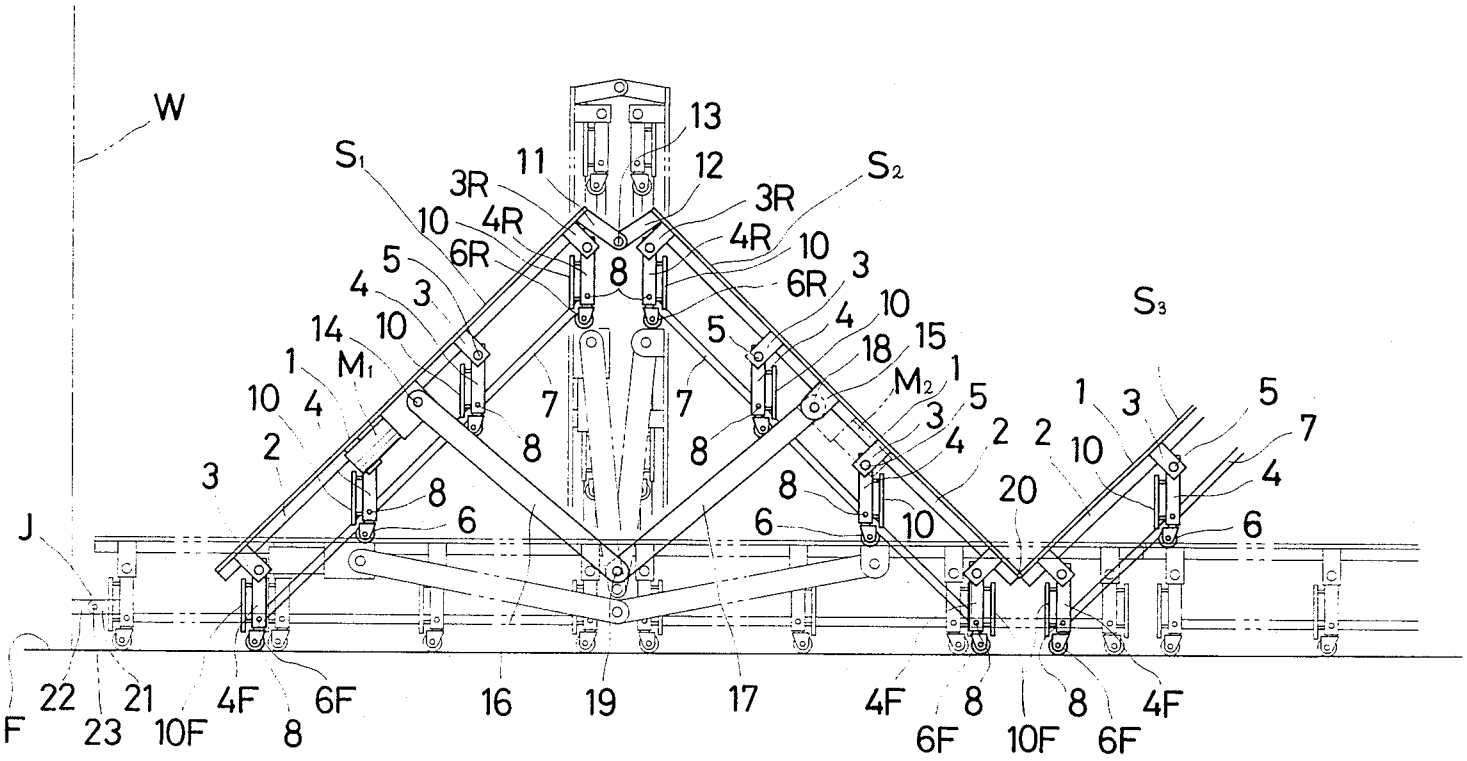
FIG. 1 is a side view of a high-type electrically-operated folding stage system according to the invention.
Figure 2:
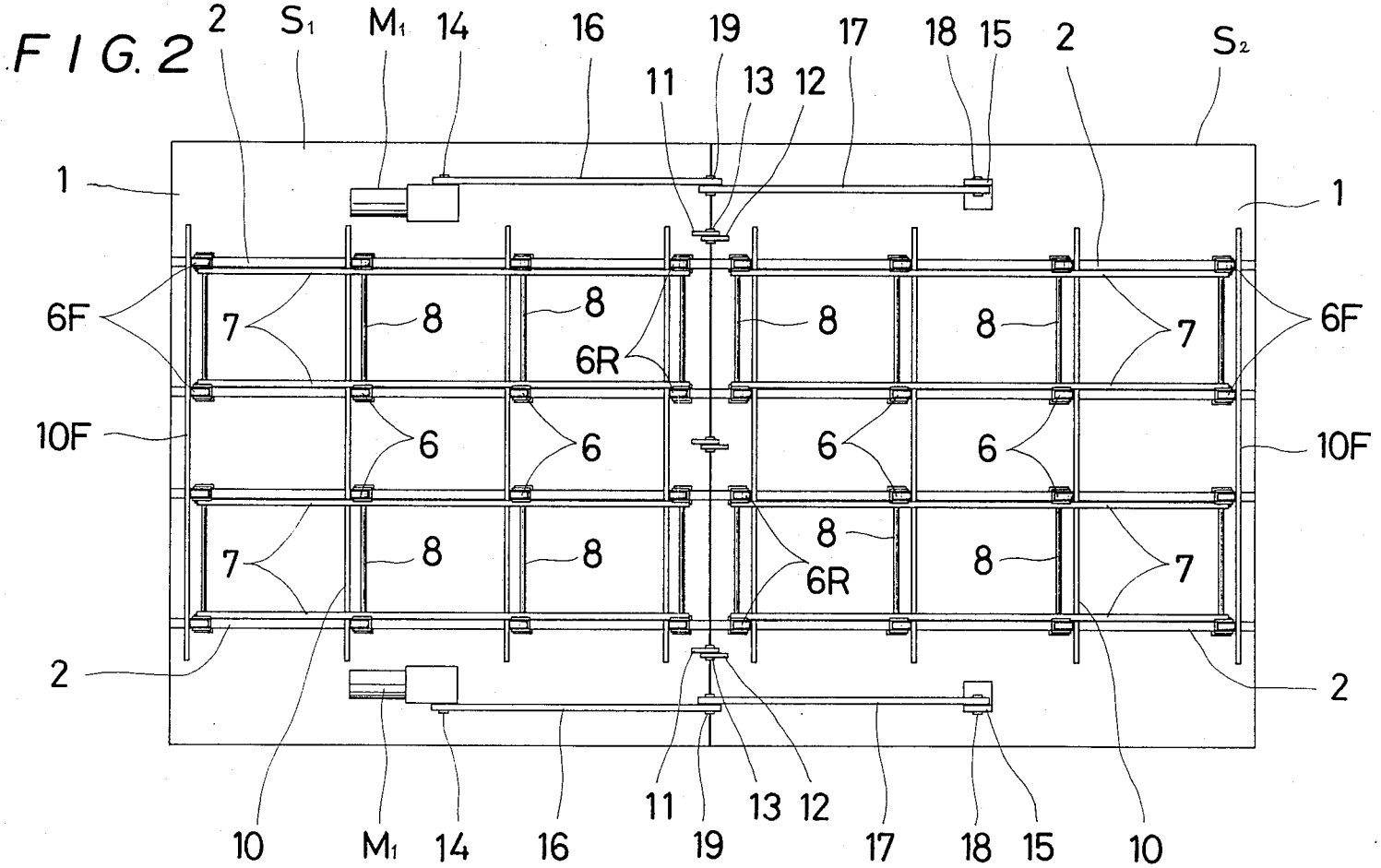
FIG. 2 is a bottom view of the system of FIG. 1.

FIGS. 1 and 2 depict a preferred embodiment of a high-type electrically-operated folding stage system according to the invention. The stage system of FIGS. 1 and 2 includes a pair of first and second stage components $S_1$ and $S_2$ The components $S_1$ and $S_2$ provide a stage when they are in their horizontal positions as shown in phantom, and are collapsible or foldable to a vertical position as shown in phantom. As illustrated, the stage system may further include a pair of third and fourth stage components $S_3$ and $S_4$. The third component $S_3$ is connected to the second component $S_2$. In FIG. 1, only a portion of the component $S_3$ is shown and the component $S_4$ is not shown. The stage system may be used, for example, with the first component $S_1$ as the foremost stage.

Each stage component includes a platform 1 fixed to beams 2. A plurality of fixed brackets 3 are suspended from each platform 1 in four rows. Each row consists of four brackets 3 as illustrated in FIG. 1. If desired, the beams 2 instead of the brackets 3 may be used to provide means equivalent to the brackets 3. An upright leg 4 is pivotally connected to the lower end of each bracket 3 by means of a pin 5. A caster 6 is connected to the lower end of each leg 4 to facilitate the movement of the entire stage system on a floor F in a desired direction. The legs 4 in each row are connected, at their lower end portions, to one another by means of a connection beam 7. The beam 7 is pivotally connected to the lower end portion of each leg 4 by means of a transverse rod 8. As shown in FIG. 2, each rod 8 bridges the right-hand or left-hand two adjacent beams 7 as viewed from either the left or the right side in FIG. 2. Since each leg 4 is thus pivotally connected at its both ends, the legs 4 of each row are in their upright positions at all times and become vertically aligned with one another when the stage components are folded to a vertical position shown in phantom.

Numerals 4F and 4R designate the foremost and rearmost legs, respectively, of the rightmost row of the legs 4 of the stage component $S_1$ as viewed from the left side of FIG. 1. With regard to the stage component $S_2$, numerals 4F and 4R designate the foremost and rearmost legs, respectively, of the leftmost row of the legs 4 as viewed from the right side of FIG. 1. Also, numerals 6F and 6R designate the casters connected to the foremost and rearmost legs 4F and 4R, respectively.

If desired, the brackets 3 may be omitted and instead the legs 4 may be pivotally connected to the frames 2.

Also, if desired, a caster or casters may be connected either only to the foremost leg 4F of each row of the legs 4 or only to the foremost and rearmost legs 4F and 4R of each row of the legs 4.

The legs 4 of each rank are connected to one another by means of a reinforcing plate 10 fixed to each leg 4 of the rank. The reinforcing plate 10F connecting the legs 4 of the first rank serves to keep the greater part of the portion of the stage system below the platforms 1 from the sight from the left side of FIG. 1.

The stage components $S_1$ an $S_2$ are connected to each other by means of three pairs of brackets 11 and 12. The brackets 11 are fixed to the bottom of the rear end portion of the platform 1 of the component $S_1$. The brackets 12 are fixed to the bottom of the rear end portion of the platform 1 of the component $S_2$. Each pair of brackets 11 and 12 are pivotally connected to each other by means of a pin 13. As shown in FIG. 1, unlike the bracket 3, each bracket 11 or 12 is not perpendicular to the platform 1, but is slightly inclined in an inward direction. Since the two components $S_1$ and $S_2$ are thus connected to each other, the components are movable between their vertical positions and horizontal positions.

A pair of opposed geared motors $M_1$ are connected to the bottom of the platform 1 of the stage component $S_1$. Both motors $M_1$ are located at a substantial middle of the depth direction of the platform 1 of the component $S_1$ (if the left side of the stage system is assumed to be the front of the stage system). Also, both motors $M_1$ are located in proximity to the opposed sides of the platform, respectively. Each motor is rotatable in either direction. One of the motors $M_1$ is connected to one side portion of the platform 1. The other motor $M_1$ is connected to the opposed side portion thereof. Each motor $M_1$ has an output shaft 14. A torque limiter (not shown) is urged against the shaft 14. A link 16 is fixed, at one end thereof, to the output shaft 14 of each motor $M_1$, and is pivotally connected, at an opposed end thereof, to one end of an opposed link 17 by means of a pin 19. The link 17 has an opposed end pivotally connected to a bracket 15 by means of a pin 18. Both links 16 and 17 can be turned on the pin 19. The bracket 15 is located at a substantial middle of the depth direction of the platform 1 of the stage component $S_2$. Also, the bracket 15 is located in proximity to one of the opposed sides of the platform 1. The link 16 is a driving link, and the link 17 is a driven link. The bracket 15 is fixed to the bottom of the platform 1 of the stage component $S_2$ at a substantial middle thereof. The links 16 and 17 have the same length. The output shaft 14 of the motor $M_1$ and the pin 18 connecting the link 17 and the bracket 15 are symmetrical about the pin 19 connecting the two links 16 and 17. The axes of the two pins 19 and of the two pins 13 are all contained in the vertical plane containing an imaginary line which divides the entire stage into the two platforms 1 when the platforms are in their horizontal positions and which divides the space between the platforms into two exact halves when the platforms are in their vertical positions. All four pins 19 and 13 are vertically moved along the foregoing vertical plane.

The stage components $S_2$ and $S_3$ are connected to each other by means of a hinge 20.

Folding of the Stage System

When the stage system is to be folded from its horizontal position to its vertical position, the two motors $M_1$ are simultaneously operated to rotate their output shafts 14 clockwise (in FIG. 1) at a very low speed, e.g., at a reduction ratio of 1:24,000. Thus the lower end of the link 16 fixed to each shaft 14 is lowered, and the lower end of the opposed link 17 connected to the link 16 by the pin 19 is also lowered. This results in the distance between the shaft 14 and the pin 18 becoming smaller. At the same time the pins 13 connecting the the stage components $S_1$ and $S_2$ are raised, and the foremost casters 6F of each stage component are moved toward those of the other stage component on the floor F. The legs 4 having the other casters 6 are moved inwardly and upwardly away from the floor F while maintaining their upright postures, as shown in FIG. 1. When the stage components $S_1$ and $S_2$ have been moved to their vertical positions (as shown in phantom in FIG. 1), the motors $M_1$ are stopped.

If the second pair of the stage components $S_3$ and $S_4$ are connected to the first pair of the stage components $S_1$ and $S_2$, the geared motors $M_1$ for the first pair and geared motors for the second pair (not shown) may or may not be simultaneously operated to fold the two component pairs in a simultaneous or separate manner. Whether the two component pairs are folded in a simultaneous or separate manner, the two pairs become folded with the hinge 20 as the center while the casters 6F nearer to the hinge 20 as well as the casters 6F further therefrom come toward the hinge 20.

Unfolding of the Stage System

When the stage system is to be unfolded from its vertical position to its horizontal position, the two motors $M_1$ are simultaneously operated to rotate their output shafts 14 counterclockwise (in FIG. 1) at a very low speed, e.g., at a reduction ratio of 1:24,000. Thus the upper end of the link 16 fixed to each shaft 14 is moved downwardly and outwardly and, hence, the upper end of the link 17 is simultaneously moved downwardly and outwardly. This results in the distance between the shaft 14 and the pin 18 becoming larger. At the same time, the casters 6F of each stage component are moved outwardly away from those of the other stage component on the floor F and all the legs are moved outwardly and downwardly, while maintaining their upright positions, until the casters of the legs have made landings on the floor F. The stage system is thus unfolded.

Variations of the Means for Operating the Stage Components

If desired, an additional geared motor $M_2$ may be provided in conjunction with each geared motor $M_1$. Such an additional motor $M_2$ is mounted on the platform 1 of the stage component $S_2$, as shown in phantom in FIG. 1. More particularly, such a motor $M_2$ is connected to a substantial middle of the depth direction of the bottom of the platform 1 of the component $S_2$, and is located in proximity to one of the opposed sides of the platform 1 thereof. Like the motor $M_1$, the motor $M_2$ is rotatable in either direction.

Figure 3:
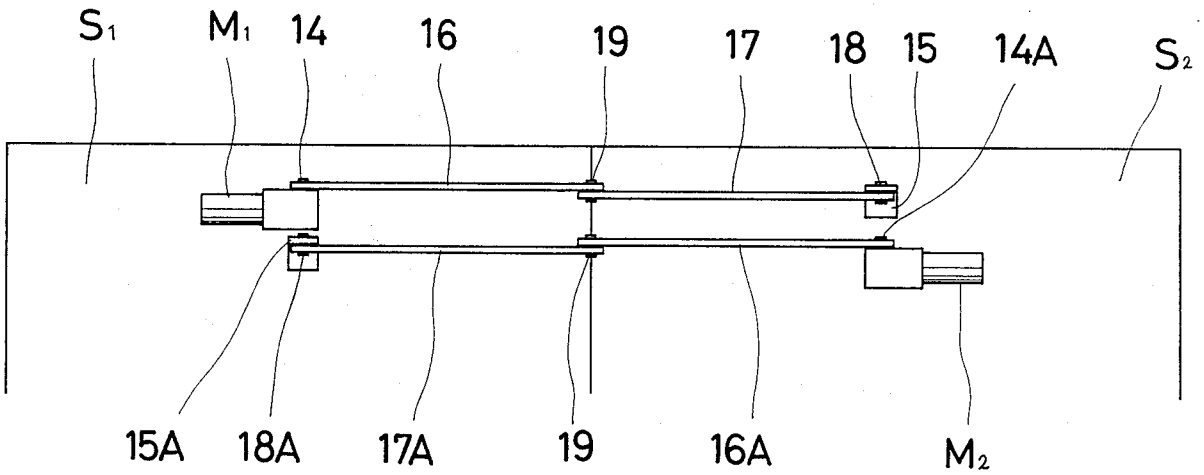
FIG. 3(*a*) shows an embodiment of a means for operating stage components of the system of FIG. 1.
Figure 3:
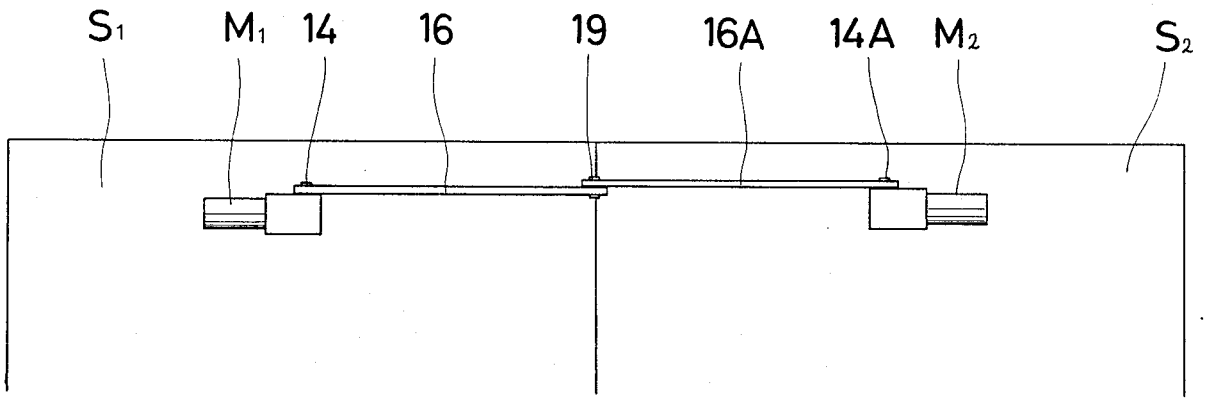

According to a preferred embodiment of the invention, a geared motor $M_2$ of FIG. 3(*a*) may be provided as such an additional motor. In FIG. 3(*a*), the motor $M_2$ has an output shaft 14A which is coaxial with the pin 18. A driving link 16A is connected, at one end thereof, to the shaft 14A. A driven link 17A is pivotally connected, at one end thereof, to the other end of the driving link 16A by means of a pin 19. The other end of the driven link 17A is pivotally connected to a bracket 15A by means of a pin 18A. The links 16A and 17A can be turned on the pin 18A. The bracket 15A is connected to the bottom of the platform 1 of the stage component $S_1$, and is located in close proximity to the motor $M_1$. The pin 18A is coaxial with the output shaft 14 of the motor $M_1$.

According to another preferred embodiment of the invention, a geared motor $M_2$ of FIG. 3(*b*) may be provided as the foregoing additional motor. In the embodiment of FIG. 3(*b*), the driven link 17 and its associated components (18 and 15) are omitted and instead the motor $M_2$ having an output shaft 14A is mounted on the platform 1 of the stage component $S_2$. In this embodiment the output shaft 14A is located in exactly the same position as the pin 18 of FIG. 3(*a*). A driving link 16A is fixed to the shaft 14A at one end thereof, and is pivotally connected, at the other end thereof, to the opposed driving link 16 by means of a pin 19. The two driving links 16 and 16A can be turned on the pin 19.

In the embodiment of either FIG. 3(*a*) or FIG. 3(*b*), the use of the additional motor $M_2$ allows the two opposed motors $M_1$ and $M_2$ each to have only half the operating force required in the case where only one of the two motors is provided. Also, such an additional motor $M_2$ may be used where stage components with relatively great sizes or weights are used and hence a greater operating force is required for the smooth operation of the components.

The stage system may be connected, by a joint means J, to a wall W of the place where the system is used or of a place where the system is stored. The joint means J includes a pair of opposed brackets 21 and 22 connected to each other by a pin 23. The bracket 21 projects horizontally from the foremost legs 4F of the component $S_1$ or from the reinforcing plate 10F fixed to the foremost legs 4F of the component $S_1$. The bracket 22 projects horizontally from the wall W. If desired, however, a joint means including a pair of opposed male and female locking members which project from the leg side and from the wall side, respectively, may be used instead of the joint means J.

The stage system may be connected to the wall W, by using the joint means J, either before or after folding or unfolding the system. If the system is connect to the wall before folding or unfolding the system, the folding or unfolding operation may be performed in a more stable manner.

In the case where it is sufficient if the stage system is moved only in the right-hand or left-hand direction (in FIG. 1), all the casters may be omitted and instead wheels may be connected only to the foremost and rearmost legs 4F and 4R of each row of the legs 4 in such a manner that the wheels do not swivel like casters, but only turn on the rods 8.

If desired, in the foregoing embodiments, the means for operating the stage components, namely, the operating mechanisms including the geared motors and the links may be provided at the center of the width direction of the system instead of in proximity to the two opposed sides of the system, or a further operating mechanism may be provided at the center of the width direction of the system in addition to the operating mechanisms provided in proximity to the two opposed sides of the system.

Variations of the Means for Connecting the Stage Components

If desired, the stage components may be connected to each other by using means other than the links 11 and 12 of FIG. 1. For example, means of FIG. 4(*a*), 4(*b*) or 4(*c*) may be used.

Figure 4:
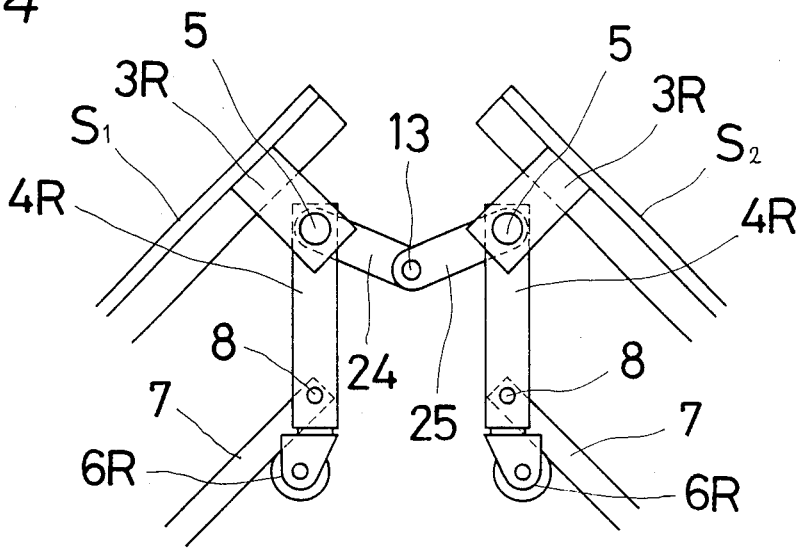
FIGS. 4(*a*), 4(*b*) and 4(*c*) show different embodiments of a means for connecting the stage components of the system of FIG. 1.
Figure 4:
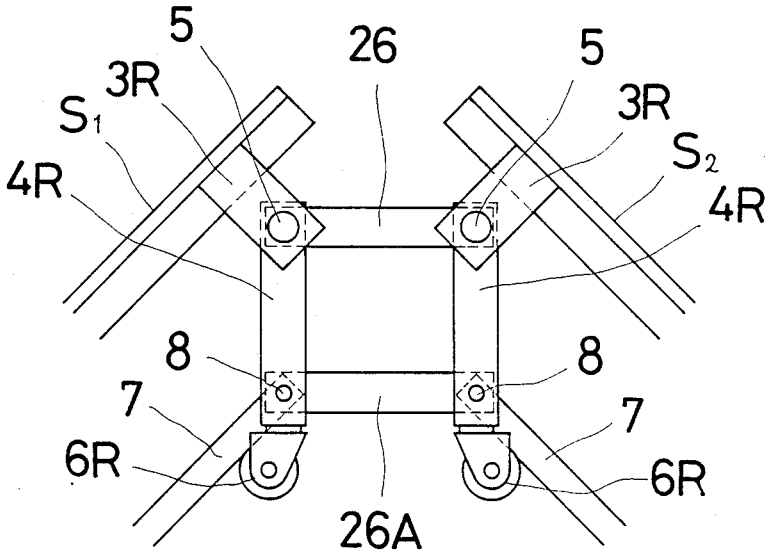
Figure 4:
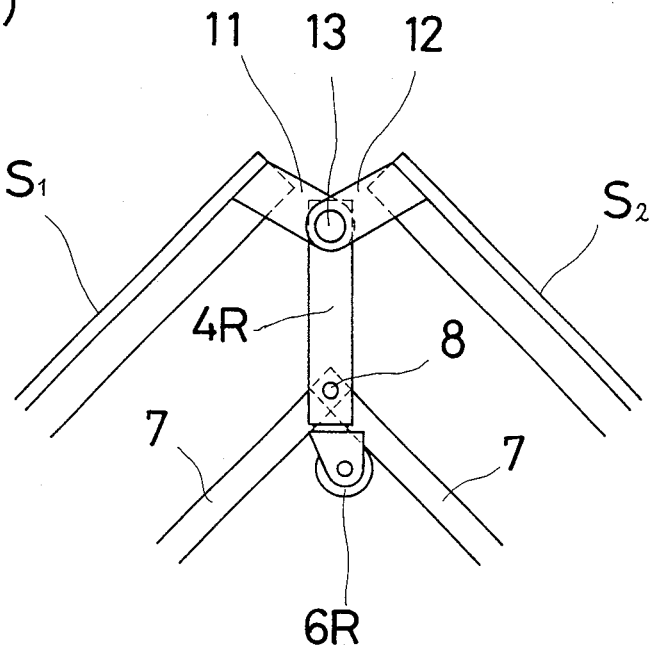

In FIG. 4(*a*) a pair of opposed links 24 and 25 are pivotally connected, at their outer ends, to the opposed pins 5 which pivotally connect the opposed rearmost legs 4R to the opposed rearmost brackets 3R, respectively. The links 24 and 25 are pivotally connected, at their inner ends, to each other by means of a pin 13.

In FIG. 4(*b*) a horizontal link 26 is pivotally connected, at its opposed ends, to the opposed pins 5 which pivotally connect the opposed rearmost legs 4R to the opposed rearmost brackets 3R, respectively. Also, a horizontal link 26A is pivotally connected, at its opposed ends, to the opposed rods 8 which pivotally connect the opposed beams 7 to the opposed rearmost legs 4, respectively. If desired, however, the lower link 26A may be omitted.

In FIG. 4(*c*), unlike in FIGS. 4(*a*) and 4(*b*), the links 11 and 12 of FIG. 1 are not omitted, but the opposed rearmost brackets 3R and the opposed rearmost legs 4R of FIG. 1 are omitted and instead a rank of rearmost legs 4R common to both the two stage components are pivotally connected to the pin 13 pivotally connecting the links 11 and 12.

Low-type Stage System

Figure 5:
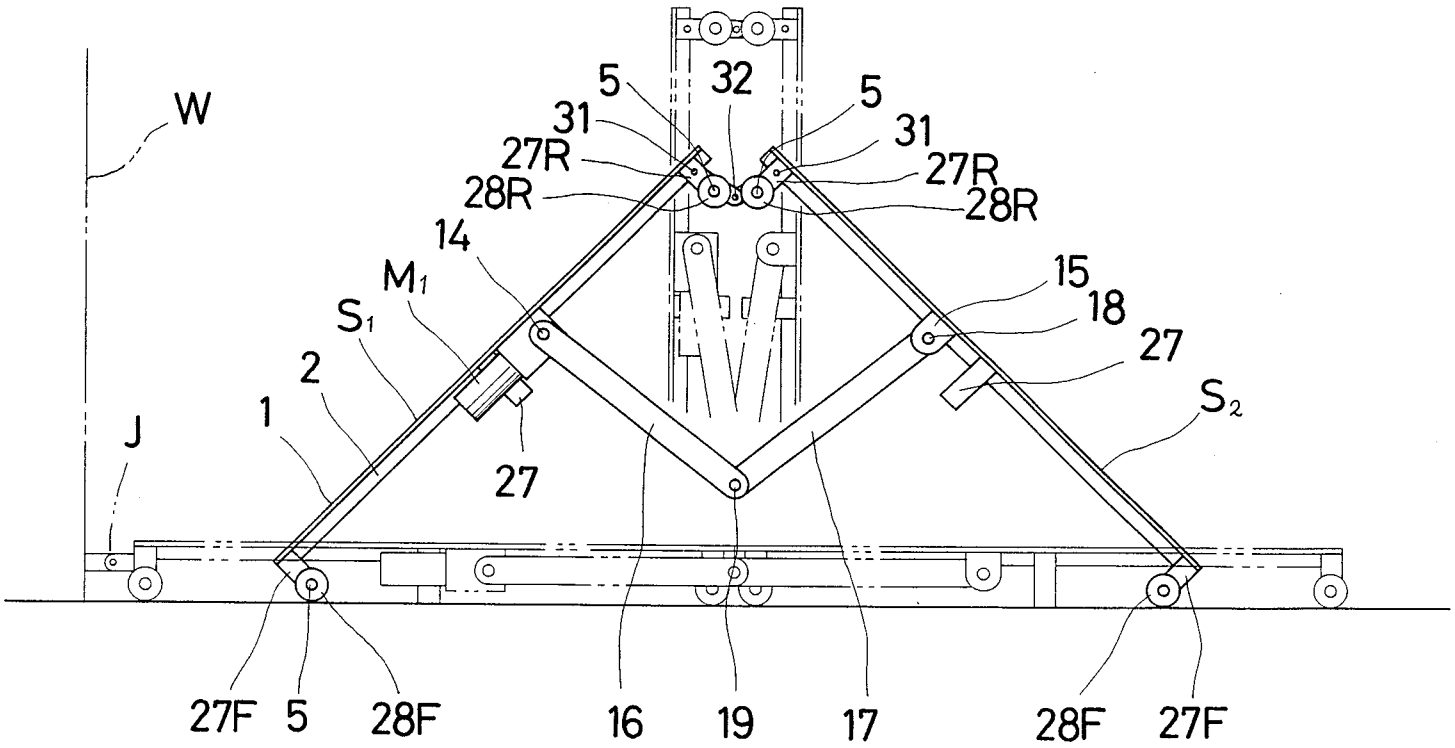
FIG. 5 is a side view of a low-type electrically-operated folding stage system according to the invention.

FIG. 5 depicts a preferred embodiment of a low-type electrically-operated folding stage system according to the invention. As with the system of FIGS. 1 and 2, the stage system of FIG. 5 includes a pair of first and second stage components $S_1$ and $S_2$. Each stage component includes two rows of relatively short legs 27 connected to the bottom of a platform 1. As shown in FIG. 5, each row of the legs 27 comprises three legs 27. A wheel 28F is connected to the lower end of each foremost leg 27F by means of a pin 5 in such a manner that the wheel may turn on the pin 5. Also, a wheel 28R is connected to the lower end of each rearmost leg 27R by means of a pin 5 in the same manner. Thus, the stage system of FIG. 5 may be moved to the right or left side in FIG. 5.

If necessary, however, a caster (not shown) instead of the mere rotatable wheel may be connected to the lower end of each of the foremost and rearmost legs 27F and 27R. Also, if required, no wheels may be connected to any legs, but a caster may be connected to the lower end of each leg. Also, if desired, all the legs may be omitted and either mere rotatable wheels or casters may be connected to the bottoms of the foremost and rearmost end portions of the platform 1.

Figure 6:
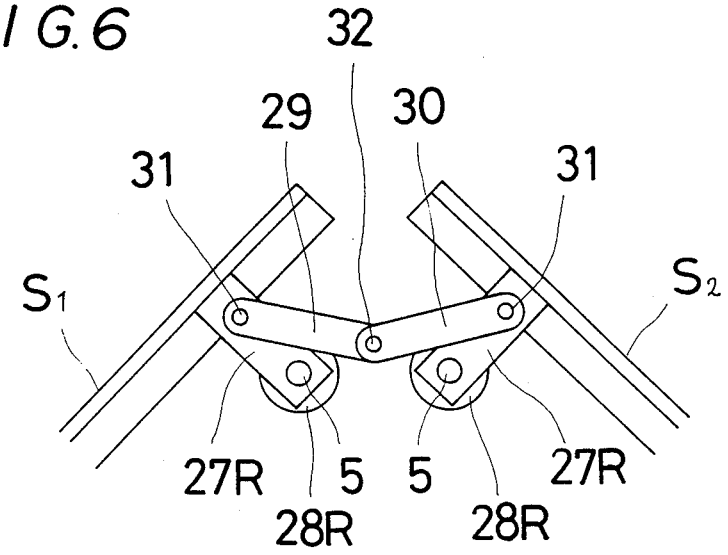
FIG. 6 is an enlarged view of a means for connecting stage components of the system of FIG. 5.

Referring to FIG. 6, the rearmost leg 27R of each row of the legs of the component $S_1$ is connected to the rearmost leg 27R of the opposed row of the legs of the component $S_2$ by means of a pair of links 29 and 30. The link 29 has one end pivotally connected to the leg 27R of the component $S_1$ by a pin 31. Similarly, the link 30 has one end pivotally connected to the opposed leg 27R of the component $S_2$ by a pin 31. The other ends of the links 29 and 30 are pivotally connected to each other by means of a pin 32. The stage components $S_1$ and $S_2$ are thus connected to each other. The stage system of FIG. 5 are constructed similarly to the stage system of FIGS. 1 and 2 in the other respects, and like reference numerals of FIG. 5 designate parts corresponding to the stage system of FIGS. 1 and 2.

If desired, the stage system of either FIG. 1 or FIG. 5 may be folded not to a vertical position, but only to the shape of an inverted "V" or, in the case where the additional pair of the stage components $S_3$ and $S_4$ are connected, to the shape of an inverted "W".

For example, the platforms 1 may be covered with mats for judo, wrestling or gymnastics in order to use the stage system for such purposes. Also, if a shock absorbing feature may be incorporated in the platform 1, the stage system may be used as a floor for kendo. The stage system may be conveniently used for such purposes, and may be easily folded when the system is to be cleared away.

In contrast with the conventional stage system of the type having a guide post fixed to a wall, the stage system of the invention provides a sufficient stage depth even in a place with a floor-to-ceiling height of only 3 to 4 meters. Therefore, the stage system may be advantageously used, for example, in a schoolroom, a recreation room or an assembly room of a school or a kindergarten or in an assembly room, a council room or a grand hall of a hotel or the like. Also, since any portion of the system is not fixed, in use, to an external object either permanently or temporarily, the system may be freely moved to a desired place inside or outside a building and may be used there. Thus the system may be conveniently used either as an outdoor stage or as an indoor stage. Moreover, after the system has been compactly folded, it may be removed, e.g., to a space near a wall or into a storeroom, to clear the floor. Furthermore, the system is electrically or automatically unfolded or folded, the system is a labor-saving one.

What is claimed is:

1. An electrically-operated folding stage system comprising (a) at least a pair of stage components each including a platform, (b) a means for pivotally connecting the stage components to each other, (c) means for moving the stage components on a floor, (d) a pair of opposed first and second geared motors mounted on the bottom of the platform of at least a first of the stage components for folding the stage components from horizontal positions to opposed vertical positions or unfolding the stage components from the vertical positions to the horizontal positions, (e) each said geared motor being rotatable in either of two opposed directions, (f) each said geared motor having a rotatable output shaft, (g) a pair of opposed first and second link mechanisms, (h) said first link mechanisms comprising a first link and a second link and said second link mechanism comprising a third link and a fourth link, (i) said first link having one end fixed to said output shaft of said first geared motor, (j) a first pivot means for pivotally connecting an opposed end of said first link and one end of said second link, (k) a second pivot means for pivotally connecting an opposed end of said second link to the bottom of the platform of a second of the stage components, (l) said third link having one end fixed to said output shaft of said second gear, (m) a third pivot means for pivotally connecting an opposed end of said third link to one end of said fourth link, (n) a fourth pivot means for pivotally connecting an opposed end of said fourth link to the bottom of the platform of the second stage component, (o) said links of each said link mechanism being in substantially horizontal positions when the stage components are in horizontal positions, but making upward articulating movements, about said first and third pivot means, to substantially vertical opposed positions when the associated geared motor is rotated in one of said two opposed directions, thereby moving or folding the stage components from said horizontal positions to opposed vertical positions, (p) said links of each said link mechanism making downward articulating movements, about said first and third pivot means, from said substantially vertical opposed positions to said substantially horizontal positions when the associated geared motor is rotated in the other of said two opposed directions, thereby moving or unfolding the stage components from said opposed vertical positions to said horizontal positions, and (q) said first and second geared motors and all of said links becoming included inside the stage components when the stage components are folded to said opposed vertical positions.

2. A stage system in accordance with claim 1 including plural pairs of said stage components which are connected to each other by hinge means.

3. A stage system in accordance with claim 1 further including (a) a plurality of transversely arranged rows of brackets fixed to the bottom of the platform of each said stage component, (b) a downwardly-extending leg pivotally connected to each said bracket for supporting the platform on the floor, (c) a beam for connecting the lower ends of all the legs connected to the brackets of each said row, (d) said beam being pivotally connected to the lower ends of the legs, (e) said means for moving the stage components on the floor comprising wheels connected to the lower ends of at least respective one of the legs which are connected to a foremost one and a rearmost one of said brackets of each said row, respectively, the connection of the wheels to the legs being made in such a manner that the wheels enable the entire stage system to be moved at least in either of two opposed horizontal directions on the floor, (f) each said leg being in upright positions at all times, i.e., being upright positions not only when supporting the platform on the floor, but also while the stage components are being folded and when the stage components have been folded, and (g) the brackets, the legs and the beams all becoming included inside the stage components when the stage components are folded to the opposed vertical positions.

4. A stage system in accordance with claim 3 wherein said wheels are casters to enable the entire stage system to be moved in a desired horizontal direction on the floor.

5. A stage system in accordance with claim 3 wherein said wheels are connected to the lower ends of all the legs connected to the brackets of each said row, and said wheels are casters to enable the entire stage system to be moved in a desired horizontal direction on the floor.

6. A stage system in accordance with claim 1 further including (a) a plurality of transversely arranged rows of downwardly-extending legs fixed to the bottom of the platform of each said stage component for supporting the platform on the floor, (b) said means for moving the stage components on the floor comprising wheels connected to the lower ends of at least a foremost one and a rearmost one of said legs of each said row, the connection of the wheels to the legs being made in such a manner that the wheels enable the entire stage system to be moved at least in either of two opposed horizontal directions on the floor, and (c) all the legs and all the wheels becoming included inside the stage components when the stage components are folded to the opposed vertical positions.

7. A state system in accordance with claim 6 wherein said wheels are casters to enable the entire stage system to be moved in a desired horizontal direction on the floor.

8. A stage system in accordance with claim 1 wherein said stage components are constructed specially for the use of the system as a floor on which such sports as judo, wrestling, gymnastics or kendo may be practiced.

* * * * *